US008117692B1

(12) United States Patent
Richards

(10) Patent No.: US 8,117,692 B1
(45) Date of Patent: Feb. 21, 2012

(54) SHEET SYSTEM FOR MATTRESS PROTECTION

(76) Inventor: Sean A. Richards, Brockton, MA (US)

( * ) Notice: Subject to any disclaimer, the term of this patent is extended or adjusted under 35 U.S.C. 154(b) by 0 days.

(21) Appl. No.: 13/198,440

(22) Filed: Aug. 4, 2011

(51) Int. Cl.
*A47G 9/00* (2006.01)

(52) U.S. Cl. ..... 5/484; 5/482; 5/500

(58) Field of Classification Search ..... 5/482, 484, 5/496–502, 494
See application file for complete search history.

(56) References Cited

U.S. PATENT DOCUMENTS

| | | | | | |
|---|---|---|---|---|---|
| 3,570,026 | A | * | 3/1971 | Allison | 5/486 |
| 4,922,565 | A | * | 5/1990 | Blake | 5/484 |
| D317,841 | S | | 7/1991 | Mendyk | |
| 5,042,099 | A | | 8/1991 | Brenner et al. | |
| 5,070,561 | A | * | 12/1991 | Keidser | 5/482 |
| 5,086,530 | A | * | 2/1992 | Blake | 5/484 |
| 5,092,010 | A | * | 3/1992 | Wong | 5/496 |
| 6,098,219 | A | | 8/2000 | Milber | |
| 6,886,197 | B1 | | 5/2005 | Madigan | |
| 7,086,102 | B1 | | 8/2006 | Frazier | |
| 8,032,959 | B2 | * | 10/2011 | Rowson et al. | 5/496 |
| 2008/0222805 | A1 | | 9/2008 | Saunders | |
| 2009/0044337 | A1 | | 2/2009 | McKee | |
| 2009/0293195 | A1 | | 12/2009 | McGrath et al. | |
| 2010/0154119 | A1 | | 6/2010 | Shuttleworth | |

* cited by examiner

*Primary Examiner* — Fredrick Conley

(57) ABSTRACT

A sheet system having a primary sheet adapted to fit around a mattress and a secondary sheet for attaching atop the primary sheet. The primary sheet has a protective layer disposed between the top and bottom surfaces for providing moisture protection, and the secondary sheet has a protective layer disposed between the top and bottom surfaces for providing moisture protection. A plurality of attachment means connect the sheets together temporarily.

6 Claims, 3 Drawing Sheets

SHEET SYSTEM FOR MATTRESS PROTECTION

FIELD OF THE INVENTION

The present invention is directed to a system of sheets for mattresses.

BACKGROUND OF THE INVENTION

Bedwetting is a common problem for young children or those with limited bladder control. Changing sheets in the middle of the night can be a huge inconvenience. The present invention features a novel sheet system for protecting mattresses and providing an easy means of changing sheets in the middle of the night if needed.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
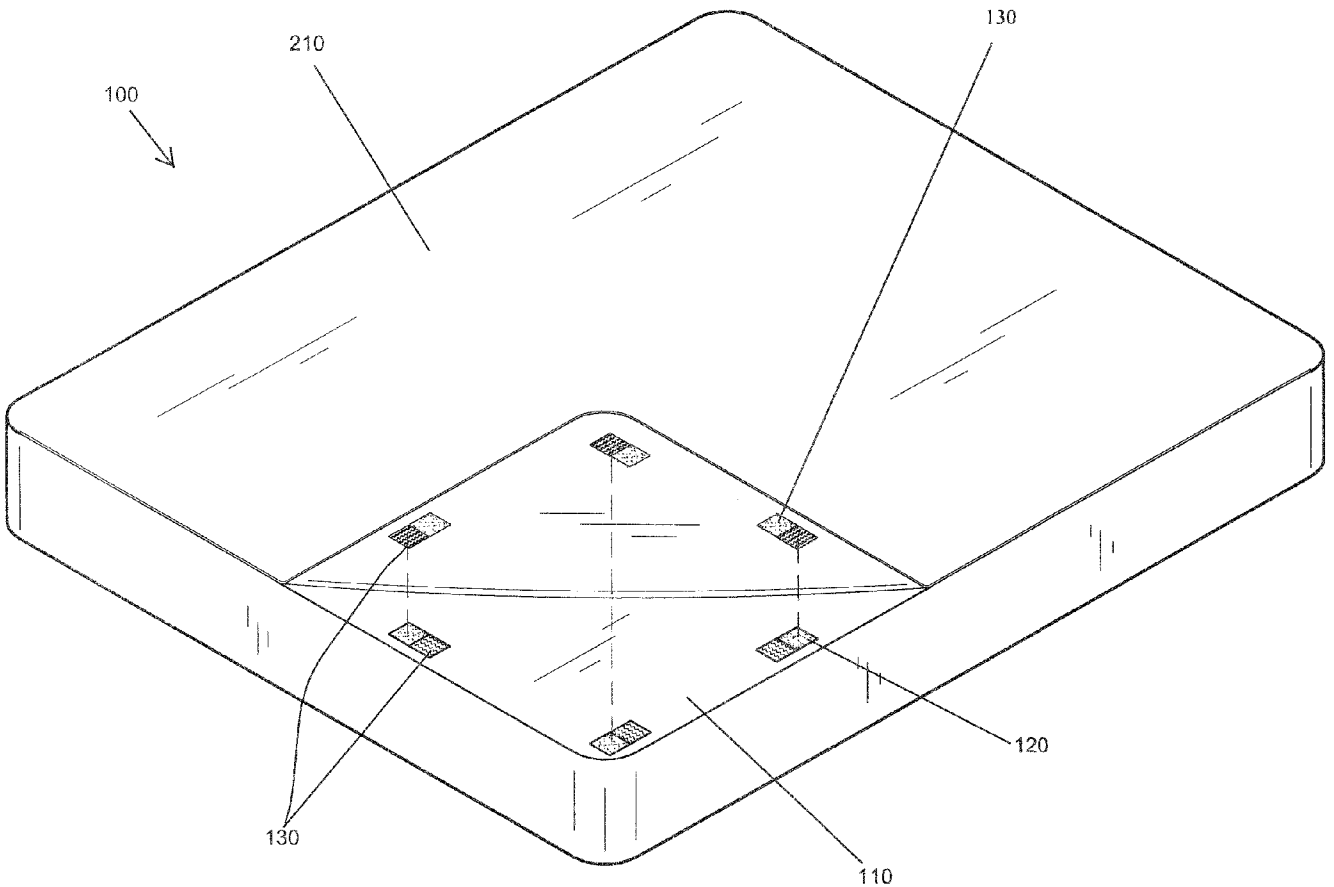
FIG. 1 is a perspective view of a sheet system for mattress protection.
Figure 2:
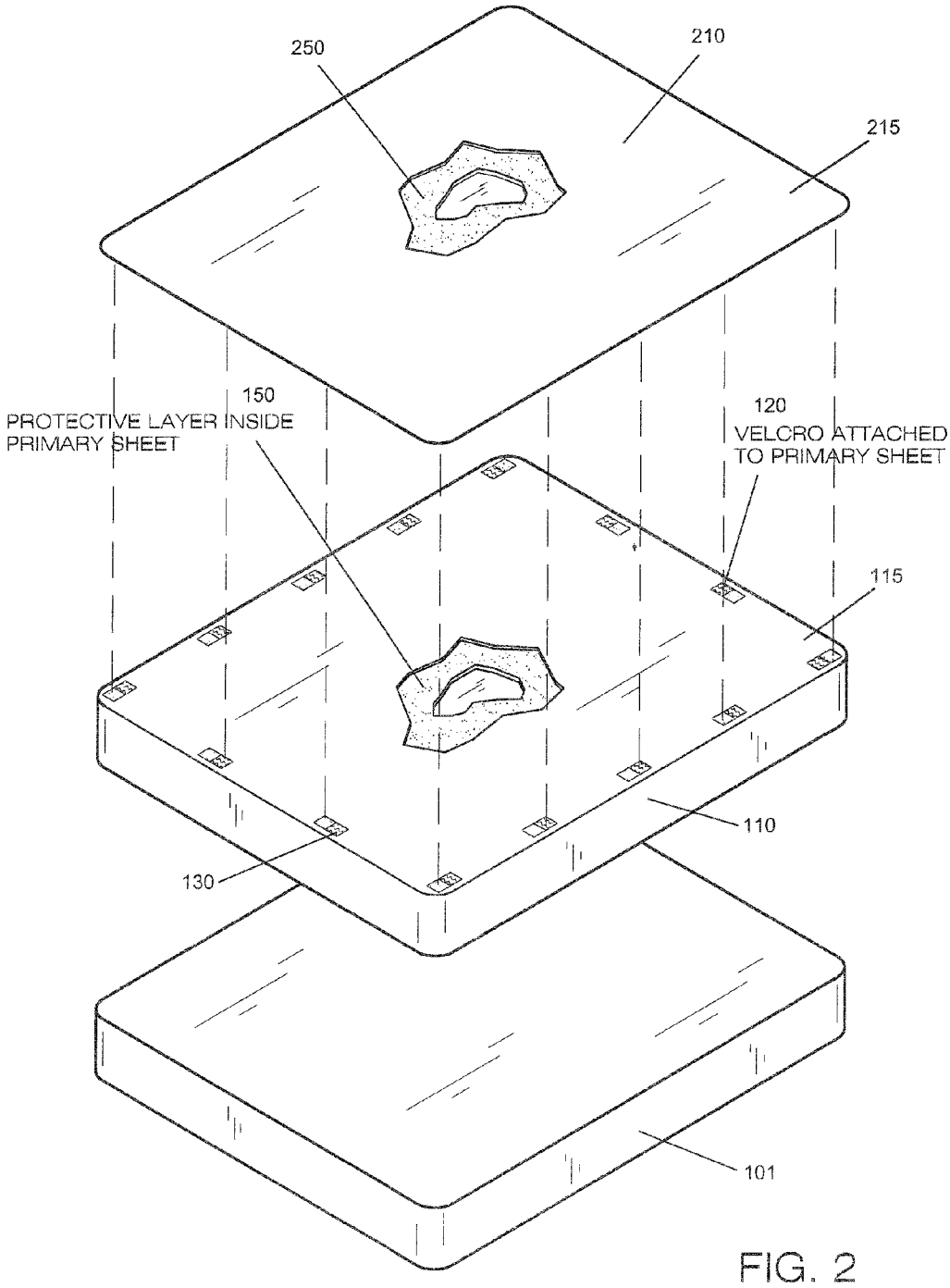
FIG. 2 is another perspective view of a sheet system for mattress protection showing the sheets separated.
Figure 3:
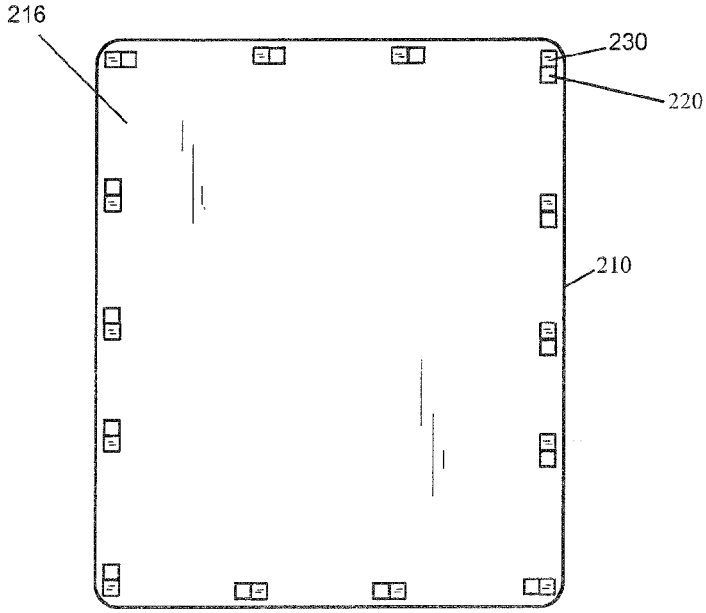
FIG. 3 is a bottom view of the secondary sheet of a sheet system for mattress protection.
Figure 4:
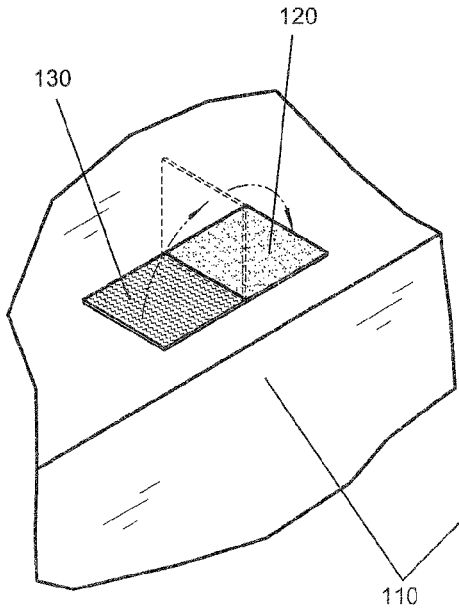
FIG. 4 is an exploded view of the primary sheet of a sheet system for mattress protection showing the Velcro protective flap opened.
Figure 5:
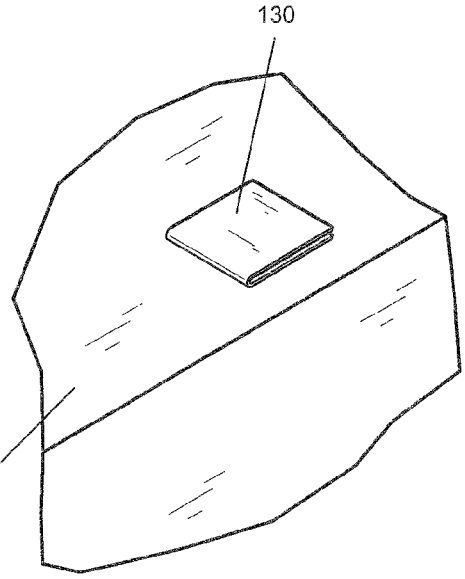
FIG. 5 is an exploded view of the primary sheet of a sheet system for mattress protection showing the Velcro protective flap closed.

Referring now to FIGS. 1-5, the present invention features a sheet system 100 for providing mattress protection as well as an easy means of changing sheets (e.g., after bedwetting in the middle of the night).

The system 100 comprises a primary sheet 110. The primary sheet 110 resembles standard fitted sheets, which are well known to one of ordinary skill in the art. For example, the primary sheet 110 has a top surface 115 (e.g., a top layer), a bottom surface (e.g., a bottom layer), a first corner, a second corner, a third corner, and a fourth corner. Each corner comprises an elastic edge to allow the corners to fit around mattress 101 corners in a conventional manner.

Disposed between the top surface 115 (e.g., top layer) of the primary sheet 110 and the bottom surface (e.g., bottom layer) of the primary sheet is a second protective layer 150. The second protective layer 150 provides moisture protection to help prevent leaking of liquid (e.g., urine) onto the mattress 101. The second protective layer 150 may be constructed from a variety of materials including but not limited to moisture-resistant nylon, moisture-proof nylon, neoprene, rubber, plastic (e.g., soft plastic sheet), the like, or a combination thereof.

The system 100 further comprises a secondary sheet 210 for attaching atop the primary sheet 110. The secondary sheet has a top surface 215 (e.g., a top layer), a bottom surface 216 (e.g., a bottom layer), a first corner, a second corner, a third corner, and a fourth corner. Generally, the secondary sheet 210 is sized to cover all or a portion of the primary sheet 110.

Disposed between the top surface 215 (e.g., top layer) of the secondary sheet 210 and the bottom surface 216 (e.g., bottom layer) of the secondary sheet 210 is a first protective layer 250. The first protective layer 250 provides moisture protection to help prevent leaking of liquid (e.g., urine) onto the primary sheet 110. The first protective layer 250 may be constructed from a variety of materials including but not limited to moisture-resistant nylon, moisture-proof nylon, neoprene, rubber, plastic (e.g., soft plastic sheet), the like, or a combination thereof.

Disposed on the top surface 115 of the primary sheet 110 is a plurality of first attachment means 120. The first attachment means 120 may be arranged in any fashion. For example, in some embodiments, the first attachment means 120 are arranged around the outer edges (and corners) of the primary sheet 110. In some embodiments, the first attachment means 120 are disposed at the corners of the primary sheet 110. In some embodiments, the first attachment means 120 are positioned at the corners, the edges, and on portions of the center of the primary sheet 110. The present invention is not limited to the aforementioned configurations of the first attachment means 120.

Disposed on the bottom surface 216 of the secondary sheet 110 is a plurality of second attachment means 220. The second attachment means 220 are adapted to engage and temporarily attach to the first attachment means 120. The second attachment means 220 are arranged to align with the first attachment means 120. For example, if the first attachment means 120 are arranged along the outer edge of the primary sheet 110 (e.g., see FIG. 2), then the second attachment means 220 are arranged along the outer edge of the secondary sheet 210 (e.g., see FIG. 3).

In some embodiments, first protective flaps 130 are disposed adjacent to each first attachment means 120. The first protective flaps 130 function to temporarily cover the first attachment means 120, for example if the secondary sheet 210 is not atop the primary sheet 110. For example, if the first attachment means 120 are hook-and-loop fasteners, the first protective flaps 130 can help prevent a user from scratching himself or herself when laying atop the primary sheet 110 on its own. The first protective flaps 130 can move between at least a first position and a second position, wherein in the first position the first protective flaps 130 cover the first attachment means 120 (e.g., see FIG. 5) and in the second position the first protective flaps 130 leave exposed the first attachment means 120 (e.g., see FIG. 4).

In some embodiments, second protective flaps 230 are disposed adjacent to each second attachment means 220. The second protective flaps 230 function to temporarily cover the second attachment means 220. The second protective flaps 230 can move between at least a first position and a second position, wherein in the first position the second protective flaps 230 cover the second attachment means 220 and in the second position the second protective flaps 230 leave exposed the second attachment means 220.

In some embodiments, the attachment means 120, 220 are snap systems, hook-and-loop systems, magnet systems, clip systems, buckle systems, the like, or a combination thereof.

In some embodiments, the primary sheet 110 is put onto the mattress 101 in a conventional manner. The secondary sheet 210 is then attached to the top of the primary sheet 110. If the user wets the bed, he/she can remove the secondary sheet 210 easily by removing the secondary sheet 210 (and optionally moving the first protective flaps 130 to the first position) and sleep on the primary sheet 110. The primary sheet 110 still provides protection against moisture in the event the user wets the bed again.

As used herein, the term "about" refers to plus or minus 10% of the referenced number. For example, an embodiment wherein the secondary sheet 220 is about 100 inches in length includes a secondary sheet 220 that is between 90 and 110 inches in length.

The disclosures of the following U.S. patents are incorporated in their entirety by reference herein: U.S. Design Pat. No. D317841; U.S. Pat. No. 5,042,099; U.S. Pat. No. 6,098,219; U.S. Pat. No. 6,886,197; U.S. Pat. No. 7,086,102; U.S. Patent Application No. 2008/0222805; U.S. Patent Application No. 2009/0044337; U.S. Patent Application No. 2009/0293195; and U.S. Patent Application No. 2010/0154119.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A sheet system 100 comprising:

(a) a primary sheet 110 having a top surface 115, a bottom surface, and corners adapted to fit around corners of a mattress 101 in a conventional manner, wherein a second protective layer 150 is disposed between the top surface 115 and the bottom surface of the primary sheet 110, the second protective layer 150 provides moisture protection;

(b) a secondary sheet 210 for attaching atop the primary sheet 110, the secondary sheet 210 has a top surface 215, a bottom surface 216, and corners, the secondary sheet 210 is sized to cover all or a portion of the primary sheet 110, wherein a first protective layer 250 is disposed between the top surface 215 and the bottom surface 216 of the secondary sheet 210, the first protective layer 250 provides moisture protection;

(c) a plurality of first attachment means 12*n* disposed on the top surface 115 of the primary sheet 110, and a plurality of second attachment means 220 disposed on the bottom surface 216 of the secondary sheet 210, the second attachment means 220 are adapted to engage and temporarily attach to the first attachment means 120, the second attachment means 220 are arranged to align with the first attachment means 120; and (d) first protective flaps 130 disposed adjacent to each first attachment means 120, the first protective flaps 130 can move between at least a first position and a second position, wherein in the first position the first protective flaps 130 cover the first attachment means 120 and in the second position the first protective flaps 130 leave exposed the first attachment means 120.

2. The system of claim 1, wherein the second protective layer 150 is constructed from a material comprising moisture-resistant nylon, moisture-proof nylon, neoprene, rubber, plastic, or a combination thereof.

3. The system of claim 1, wherein the first protective layer 250 is constructed from a material comprising moisture-resistant nylon, moisture-proof nylon, neoprene, rubber, plastic, or a combination thereof.

4. The system of claim 1 further comprising second protective flaps 230 disposed adjacent to each second attachment means 220, the second protective flaps 230 can move between at least a first position and a second position, wherein in the first position the second protective flaps 230 cover the second attachment means 220 and in the second position the second protective flaps 230 leave exposed the second attachment means 220.

5. The system of claim 1, wherein the first attachment means 120 is a hook-and-loop fastener.

6. The system of claim 5, wherein the second attachment means 120 is a hook-and-loop fastener.

* * * * *